US008669869B2

(12) United States Patent
Takaya

(10) Patent No.: US 8,669,869 B2
(45) Date of Patent: Mar. 11, 2014

(54) METHOD AND DEVICE FOR DETECTING AND REPORTING ACTIVITY

(75) Inventor: Norifumi Takaya, San Diego, CA (US)

(73) Assignee: Sony Corporation, Tokyo (JP)

( * ) Notice: Subject to any disclaimer, the term of this patent is extended or adjusted under 35 U.S.C. 154(b) by 145 days.

(21) Appl. No.: 13/225,023

(22) Filed: Sep. 2, 2011

(65) Prior Publication Data

US 2013/0057403 A1 Mar. 7, 2013

(51) Int. Cl.
*G08B 1/00* (2006.01)

(52) U.S. Cl.
USPC ..... 340/541; 340/506; 340/3.1; 340/538; 340/539.1

(58) Field of Classification Search
USPC ..... 340/506, 541, 3.1, 539.1, 538
See application file for complete search history.

(56) References Cited

U.S. PATENT DOCUMENTS

| | | | | |
|---|---|---|---|---|
| 5,400,246 | A * | 3/1995 | Wilson et al. | 700/17 |
| 7,721,305 | B2 | 5/2010 | Anderson | |
| 7,746,223 | B2 | 6/2010 | Howarter et al. | |
| 2011/0057796 | A1 | 3/2011 | Candelore | |

OTHER PUBLICATIONS

Kazuki Nakajima et al.; *E-mail-based Telemonitoring System of Television's Operating State for Elderly Persons Living Alone*; The 23rd International Technical Conference on Circuits/Systems, Computers and Communications (ITC-CSCC 2008).

Ryoji Suzuki et al.; *Rhythm of daily living and detection of atypical days for elderly people living alone as determined with a monitoring system*; Jun. 1, 2006, vol. 12 No. 4 208-214.

* cited by examiner

*Primary Examiner* — Daryl Pope
(74) *Attorney, Agent, or Firm* — Fitch, Even, Tabin & Flannery LLP

(57) ABSTRACT

A device and methods are provided for monitoring and reporting activity including providing an alert based on detected activity. In one embodiment, a method includes is monitoring activity relative to a device based on activity detected by the device, determining a baseline activity level for the device, and detecting a change in the baseline activity level. The method may further include transmitting an electronic message via a network connection based on the change in baseline line activity, the electronic message providing an alert based on the change in baseline activity level. The device and methods may advantageously allow for providing alerts based on inactivity.

20 Claims, 4 Drawing Sheets

METHOD AND DEVICE FOR DETECTING AND REPORTING ACTIVITY

FIELD

The present disclosure relates generally to electronic devices and methods, and more particularly to a device and methods for monitoring and reporting activity to provide an alert based on detected activity.

BACKGROUND

Display devices are typically used for viewing broadcast content and other types of media. Many users of displays devices can spend a significant amount of time viewing content. Recently, display device features have included non-display features. One feature, for example relates to detecting the presence of an intruder by a display device as described in U.S. Patent Publication No. 2011/0057796; entitled Apparatus and method for Operation of a Display Device to Provide a home Security Alarm, to Candelore. Candelore, which is incorporated in its entirety herein, discusses an apparatus and method of a display device to provide a home security alarm including detecting an intruder based on motion. In some cases, detecting motion alone may not be suitable for characterizing activity relative to a display device. In addition, it may be desirable to provide a method that allows for inactivity to be monitored and assessed. Because conventional devices typically detect only movement, these devices are not suitable for detecting inactivity of a viewer. Thus, improved activity sensing is desired to allow for improved monitoring.

BRIEF SUMMARY OF THE EMBODIMENTS

Disclosed and claimed herein are a device and methods for monitoring and reporting activity including providing an alert based on detected activity. In one embodiment, a method includes monitoring activity relative to a device based on activity detected by the device, determining a baseline activity level for the device, and detecting a change in the baseline activity level. The method further includes transmitting an electronic message via a network connection based on the change in baseline line activity, the electronic message providing an alert based on the change in baseline activity level. Other aspects, features, and techniques will be apparent to one skilled in the relevant art in view of the following detailed description of the embodiments.

BRIEF DESCRIPTION OF THE DRAWINGS

The features, objects, and advantages of the present disclosure will become more apparent from the detailed description set forth below when taken in conjunction with the drawings in which like reference characters identify correspondingly throughout and wherein.

DETAILED DESCRIPTION OF THE EXEMPLARY EMBODIMENTS

Overview and Terminology

Figure 2:
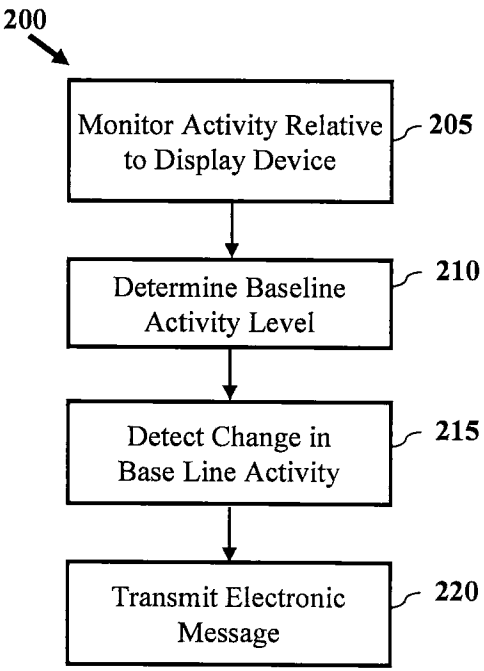
FIG. 2 depicts a process for detecting activity according to one or more embodiments.

One aspect of the disclosure relates to a device and methods for monitoring and reporting activity associated with a device. One embodiment of the disclosure is directed to an electronic device, such as a display device, that may be configured to detect and monitor activity, such as motion and/or a presence, relative to the device. The device may additionally be configured to assess the activity. One benefit of the device may be the ability to provide a security element to allow detection of an intruder or an unexpected presence. Another benefit may be the ability to monitor activity and transmit an alert message based on inactivity. Monitoring inactivity may be beneficial to allow for the detection of a user in distress.

Embodiments are directed to methods for monitoring activity and reporting activity. Activity may relate to motion or a presence detected by one or more of optical and infrared sensing. In one embodiment, a baseline activity level may be determined for the device to allow for detection of inactivity. In certain embodiments, an electronic message may be transmitted as an alert based on detection of activity and/or inactivity. Alternatively, one or more messages or prompts may be provided by the device to notify users of the inactivity detection prior to transmission of the alert.

In another embodiment, a system is providing for monitoring and reporting activity associated with a device. The system may allow for a device to communicate with a server, communication device, and/or an assistance service based on network communication. In addition, the system may allow for one or more additional sensing devices to provided activity sensing for monitoring of activity. Although the disclosure is described as relating to detection of a presence or inactivity for distress or security assistance, it should be appreciated that the device and methods described herein may be employed for one or more additional benefits and uses.

As used herein, the terms "a" or "an" shall mean one or more than one. The term "plurality" shall mean two or more than two. The term "another" is defined as a second or more. The terms "including" and/or "having" are open ended (e.g., comprising). The term "or" as used herein is to be interpreted as inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

Reference throughout this document to "one embodiment," "certain embodiments," "an embodiment," or similar term means that a particular feature, structure, or characteristic described in connection with the embodiment is included in at least one embodiment. Thus, the appearances of such phrases in various places throughout this specification are not necessarily all referring to the same embodiment. Furthermore, the particular features, structures, or characteristics may be combined in any suitable manner on one or more embodiments without limitation.

In accordance with the practices of persons skilled in the art of computer programming, one or more embodiments are described below with reference to operations that are performed by a computer system or a like electronic system. Such operations are sometimes referred to as being computer-executed. It will be appreciated that operations that are symbolically represented include the manipulation by a processor, such as a central processing unit, of electrical signals representing data bits and the maintenance of data bits at memory locations, such as in system memory, as well as other processing of signals. The memory locations where data bits are maintained are physical locations that have particular electrical, magnetic, optical, or organic properties corresponding to the data bits.

When implemented in software, the elements of the embodiments are essentially the code segments to perform the necessary tasks. The code segments can be stored in a processor readable medium, which may include any medium that can store or transfer information. Examples of the processor readable mediums include an electronic circuit, a semiconductor memory device, a read-only memory (ROM), a flash memory or other non-volatile memory, a floppy diskette, a CD-ROM, an optical disk, a hard disk, a non-transitory medium, etc.

Exemplary Embodiments

Figure 1:
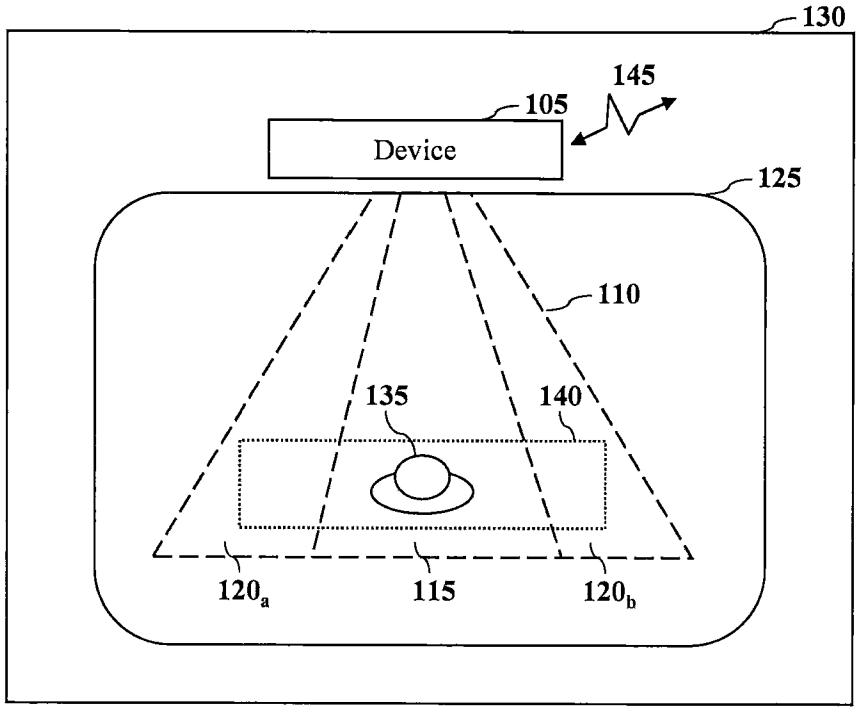
FIG. 1 depicts a graphical representation of a device monitoring activity according to one or more embodiments.

Referring now to the figures, FIG. 1 depicts a graphical representation of a device monitoring activity according to one or more embodiments. Device 105 of FIG. 1 may be configured to monitor activity based on one or more of optical and infrared detection. Device 105 may relate to one or more of display device, set-top box, communication device, media player, gaming device and electronic device in general. As depicted in FIG. 1, device 105 may be configured to monitor activity based on a detection area, such as area 110. According to one embodiment, device 105 may be configured to characterize motion or activity within area 110 relative to one or more of detection zones 115 and 120*a*-120*b*. In certain embodiments, area 110 may relate to the detection area of an optical sensor, such as an imaging device. In other embodiments, area 110 may relate to a detection area for an infrared detection system. In yet another embodiment, area 110 may relate to a primary detection area, and a second detection area, depicted as 125, may relate to a detection area of a secondary sensor. Accordingly, as used herein, monitoring activity may be based on one or more of area 110 and area 125. Device 105, area 110 and area 125 are depicted relative to room 130. In some embodiments, device 105 may be configured to receive data from a sensing device in another location, such as another room to verify or aid in a determination that an electronic message should be transmitted. Area 110 and area 125 are exemplary as depicted in FIG. 1. It should be appreciated that the embodiments of the disclosure are not limited to the areas as depicted in FIG. 1, and that other arrangements may be employed.

Based on detection areas of device 105, the device may detect the presence of a user, depicted as 135, and monitor activity. In certain embodiments, device 105 may be configured to detect the presence of an intruder or unexpected presence. Monitoring activity by device 105 may allow for detecting a presence based on motion. According to one aspect of the disclosure, device 105 may be configured determine baseline activity data for an area, such as one or more of area 110 and area 125, and detect a change in activity relative to the baseline activity data. Baseline activity data may be based on optical data and/or motion data detected by device 105 to characterize typical or average activity relative to device 105. By generating baseline activity data, an atypical activity level, unexpected presence, or periods of inactivity which may be cause for alarm may be detected. Baseline activity data may be collected for room 130, area 125, area 110 and/or zones 115 and 120*a*-120*b* within area 110. In certain embodiments, baseline activity may be based on the frequency and/or amount of activity detected within a zone or area. Alternatively, or in combination, baseline activity may be based on motion or presence relative to difference zones or areas. For example, motion or movement of an entity from zone 115 to either one of zones 120*a* and 120*b* may be detected as movement. Similarly, motion within a particular zone, such as zone 115 may, or may not, be included in baseline activity data. Accordingly, instead of merely monitoring or detecting a presence, device 105 may be configured to characterize motion and activity within room 130. In addition, the occurrence of a user in distress may be detected by device 105 based on inactivity.

As depicted in FIG. 1, area 110 may be positioned relative to an area a user is typically located, such as furniture 140. In some embodiments, activity monitoring may be adjusted based on furniture 140. When a change in baseline activity indicates a cause for alarm, device 105 may be configured to transmit an electronic message, depicted as 145, to a network location such as a server, an assistance center, communication device, etc. The communication may include image data associated with room 130. Electronic message 145 may relate to one or more of a network communication, wired communication, and wireless communication.

Device 105 may include one or more sensors for detecting motion and activity within room 130. In one embodiment, activity may be monitored based on optical images detected by device 105 of area 110, or area 125, at periodic intervals (e.g., every 1-10 seconds). In another embodiment, device 105 may include an infrared sensor allow for detecting a presence and/or motion.

Referring now to FIG. 2, a process is depicted for detecting and monitoring activity according to one or more embodiments. Process 200 may be employed by a device (e.g., device 105) to monitor activity and transmit an electronic message based on a change in baseline activity. Process 200 is described with respect to a display device; however, it should be appreciated that other types of devices may be employed.

Process 200 may be initiated by monitoring activity relative to a display device at block 205. Activity monitoring may be based on a particular mode or setting of the display device. For example, the device may be configured to disable or enable activity monitoring in certain embodiments. Monitoring activity at block 205 may be based on one or more of optical and infrared detection of activity relative to the device. Monitoring activity at block 205 may similarly be based on detecting and characterizing activity relative to one or more areas or zones (e.g., area 110, area 125, zone 115, zones 120*a*-120*b*, etc.). In another embodiment, monitoring activity at block 205 may include detecting optical image data associated with an area or zone relative to the display device. The device may be configured to store detected activity in device memory.

Based on activity data collected by the device, the device may determine a baseline activity level at block 210. A baseline activity level, as will be described in more detail with respect to FIG. 5, may be based on data collected over a period of time, such as one or more days. The baseline activity level may be based on a particular time, portion of a day, particular day of the week, a 24-hour period, or other intervals and sub-intervals in general. One aspect to the baseline activity level is to provide a means for ascertaining the difference between typical activity levels relative to a display device and unexpected situations including an unexpected presence or user in distress.

At block 215, the display device may detect a change in the baseline activity level. The change in baseline activity may be determined based on a comparison of a detected activity level for a period of time to baseline activity level for activity associated with the period of time. By way of example, for a change in activity detected during typical use of the display device, the device may compare detected activity of the user to determine a change. Alternatively, the baseline data may reflect high activity levels during a particular interval on a particular night. As such, a baseline change may be evident when activity is particularly low. A change with respect to the baseline activity level may be based on activity exceeding the baseline, or activity below the baseline.

At block 220, the device can transmit an electronic message via a network connection based on the change in baseline line activity, the electronic message providing an alert based on the change in baseline activity level. In certain embodiment, the message may be transmitted based on inactivity associated with a distress state of the user. The electronic message may relate to an email message transmitted to a dispatch service, email address and/or personal communication device requesting assistance based on a determination of inactivity. When the change in baseline activity relates to the detection of an intruder or unexpected presence, the message may provide an alert of the unexpected activity to a user, a specified recipient (e.g., neighbor, friend, etc.) or a security service. In certain embodiments, the electronic message may include image data captured by the device. Transmission of the electronic message in some instances may trigger display of an alert message on a display device as will be discussed in more detail with respect to FIG. 6. With respect to a detection of inactivity, the electronic message may be transmitted to one or more of specified locations, such as one or more of an emergency response unit, user contact, family member, etc.

Figure 3:
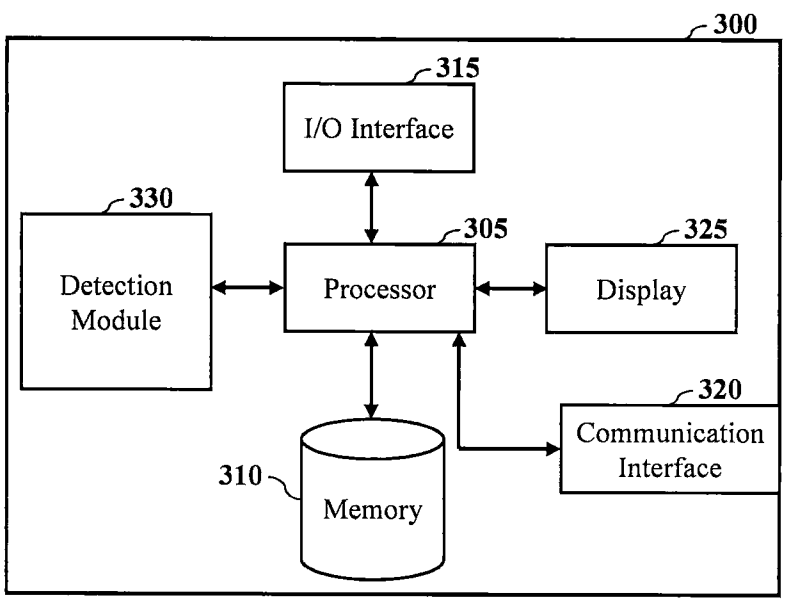
FIG. 3 depicts a simplified block diagram of a device according to one embodiment.

Referring now to FIG. 3, a simplified block diagram is depicted of a device according to one embodiment. Device 300 may relate to one or more of personal communication device, media player, imaging device, or mobile electronic device in general. In certain embodiments, device 300 relates to device 105 of FIG. 1. Device 300 may be configured to provide an application for monitoring and reporting activity. In another embodiment, device 300 may be configured to access a server based to allow for network based management of device applications and features.

As depicted in FIG. 3, a simplified block diagram is depicted of a device according to one or more embodiments. Device 300 may be one or more of a display device, set-top box, communication device, media player, gaming device or electronic device in general. Device 300 includes processor 305, memory 310, input/output (I/O) interface 315, communication interface 320, display 325 and detection module 330. Elements of device 300 may be configured to communicate and interoperate with processor 305 by a communication bus. Processor 305 may be configured to control operation of device 300 based on one or more computer executable instructions stored in memory 310. In one embodiment, processor 305 may be configured to monitor and report activity for providing an electronic message alert based on detected activity. Memory 310 may relate to one of RAM and ROM memories and may be configured to store one or more files, and computer executable instructions for operation of device 300. Although depicted as a single memory unit, memory 310 may relate to one or more of internal device memory and removable memory.

Input output (I/O) interface 315 may be configured to output data and/or commands to one or more output devices. According to one embodiment, I/O interface 315 may be configured to receive one or more user commands. I/O interface 315 may include one or more buttons to control operation of device 300 including controlling selection of content for display and controlling operation of device 300. Input buttons of I/O interface 315 may include one or more buttons for user input, such as a such as a numerical keypad, volume control, menu controls, pointing device, track ball, mode selection buttons, and playback functionality (e.g., play, stop, pause, forward, reverse, slow motion, etc). Input buttons of I/O interface 315 may include hard and soft buttons, wherein functionality of the soft buttons may be based on one or more applications running on device 300.

Communication interface 320 may include one or more elements to allow for communication by device 300 by wired or wireless communication. Communication interface 320 may include one or more ports for receiving data, including ports for removable memory. Communication interface 320 may be configured to allow for network based communications including but not limited to LAN, WAN, Wi-Fi, etc.

In certain embodiments, device 300 may include display 325 to display image data, such as video data and graphics data, alert messages, and display one or more applications executed by processor 305.

Detection module 330 may be configured to monitor activity relative to device 300. In certain embodiments, detection module 330 may include one or more of an optical and infrared detection sensor for monitoring activity. Optical image data detected by detection module 330 may be stored in memory 310 and in some cases may be transmitted in an alert by communication interface 320.

Figure 4:
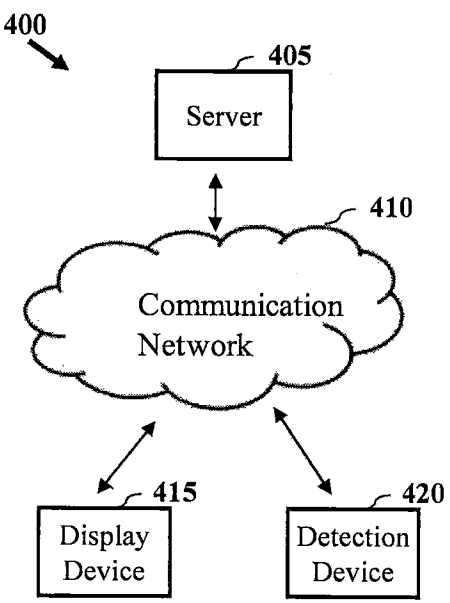
FIG. 4 depicts a simplified system diagram according to one or more embodiments.

Referring now to FIG. 4, a simplified system diagram is depicted according to one or more embodiments. System 400 may allow for monitoring and reporting activity a server, communication device or dispatch service. System 400 includes server 405, communication network 410, display device 415 and detection device 420.

Server 405 may be configured to receive electronic messages, such as alert messages from display device 415 (e.g., device 300) via communication network 410. In addition to allowing for the detection of an unexpected presence and monitoring a distress situation, system 400 may additionally allow for comparing activity data of one or more devices. For example, display device 405 may be associated with a first location and detection device 420 may relate to an activity sensor associated with a second location. Activity data provided by detection device 420 may aide in confirming an unexpected presence or distress condition.

Communication network 410 may allow for one or more of wired and wireless communication. For example, communication network 410 may allow for network based communications including, but not limited to, LAN, WAN, WI-FI, etc. Devices 415 and 220 of FIG. 4 may be configured to connect to server 405 via communication network 410, which may include wired and/or wireless components. Although system 400 is described above as having a single server, it may be appreciated that system include a plurality of servers.

Figure 5:
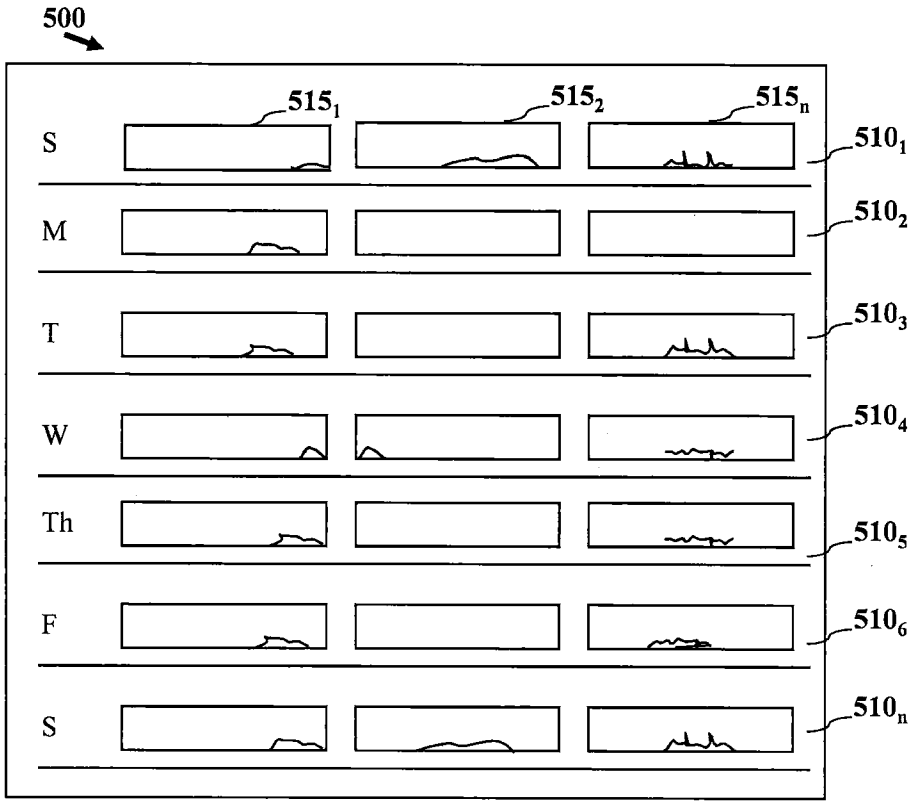
FIG. 5 depicts a graphical representation of baseline activity data according to one or more embodiments.

Referring now to FIG. 5, a graphical representation is depicted of baseline activity data according to one or more embodiments. Baseline activity data 500 may be based on monitoring activity and motion relative to a device for a period of time. In some cases, at least a 24-hour period may be required to determine preliminary baseline activity. Baseline activity data 500 is associated with each day of the week. A display device may store and update baseline activity data continually or based on periods when a device is in use. As depicted, baseline activity data 500 includes data for each day, depicted as $\mathbf{510}_{1\text{-}n}$. Baseline activity data 500 may also include one or more subintervals for each day depicted as $515_{1-n}$. In order to determine a change based on monitored activity relative to a baseline activity data, a device may compare the amount activity that exceeds or is below the baseline activity level, or an average baseline activity level, for a particular interval. In certain embodiments, changes relative to a baseline activity level may be based on sub-intervals for one or more days.

According to one embodiment, a message may be displayed by the device based on the change relative to a baseline activity level. In one embodiment, a message may be displayed by a device following transmission of an electronic message. A user response to the message may generate an additional message canceling the initial transmission. In another embodiment, a message may be displayed prior to transmission of an electronic message including the alert. The message may request a user response regarding inactivity.

Figure 6:
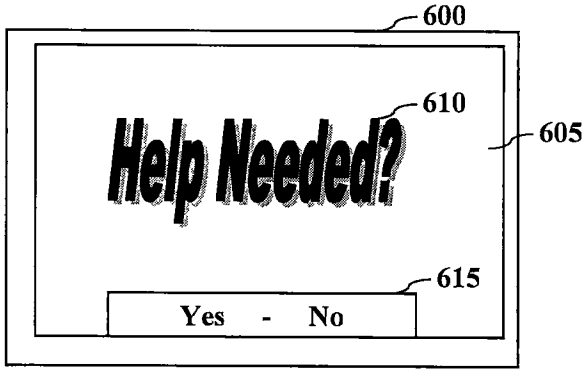
FIG. 6 depicts a graphical representation of a display device alert message according to one or more embodiments.

Referring now to FIG. 6, a graphical representation of a display device alert message according to one or more embodiments. Device 600 may include display window 605 to display alert message 610. Alert message 610 may be based on activity data monitored by the device. In certain embodiments, message 610 may be received by the device from a dispatch assistance server via a network communication message. The device may allow a user to respond by selecting a response in display area 615. Based on the user response, the device may transmit and electronic message including an alert. When message 610 relates to a message generated by a dispatch service, the service may send an emergency responder, medical personal or assistance based on a response to message 610. In certain embodiments, when an electronic message is transmitted based on a baseline activity level, message 610 may be displayed based on a communication message received from an other device. Message 610 f FIG. 6 is an exemplary message, it may be appreciated that other messages or alerts may be displayed.

Figure 7:
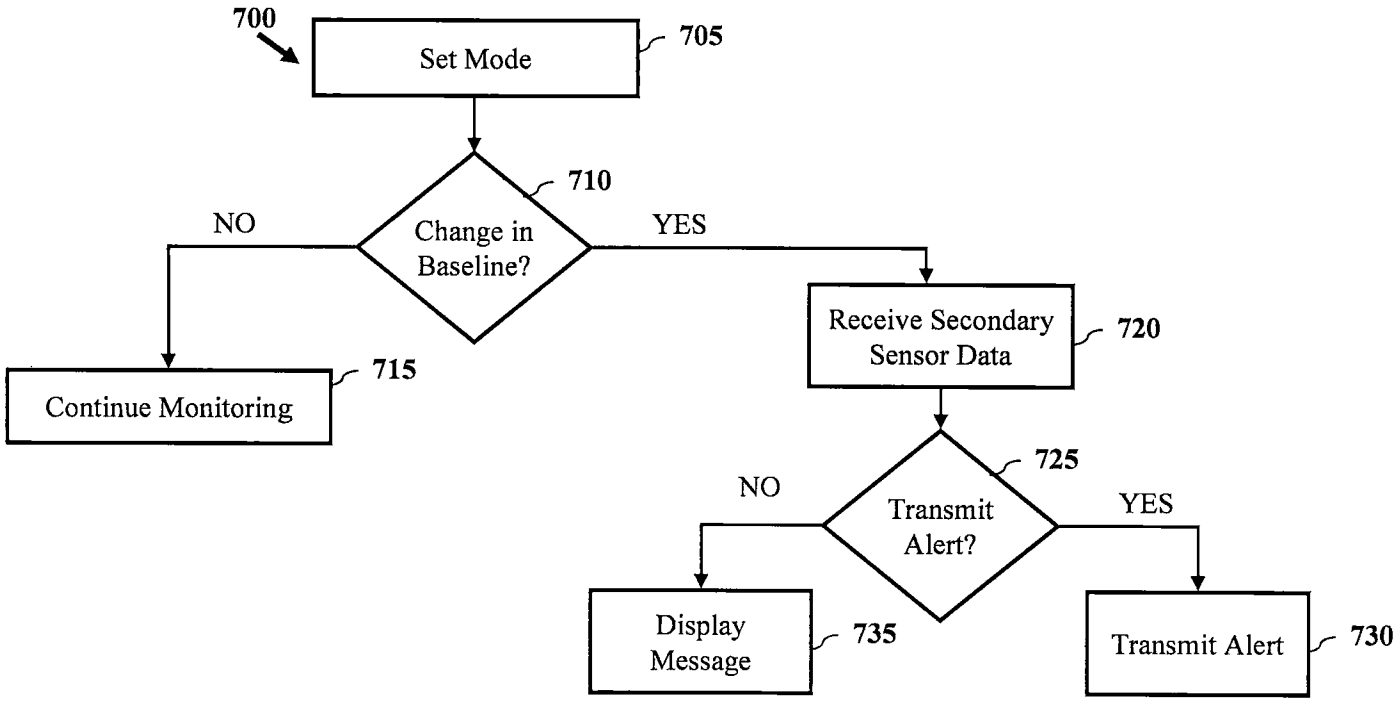
FIG. 7 depicts a process of device operation according to one or more embodiments.

Referring now to FIG. 7, a process is depicted for device operation according to one or more embodiments. Process 700 may be initiated at block 705 when a device is set to monitor activity. Based on detected activity, the device may determine a baseline activity level. At decision block 710, the device may determine whether there is a change in the baseline activity level necessary to transmit an alert message. When a detected change does not exceed a predetermined amount or threshold ("NO" path out of decision block 710), the device may continue monitoring activity at block 715. When a detected change does exceed a predetermined amount or threshold ("YES" path out of decision block 710), the device may check for secondary data at block 720 associated with a detection device separate from the device (e.g., detection device 420). At decision block 725, the device may determine whether an alert should be transmitted based on the secondary sensor data and change in baseline. Secondary sensor data may relate to activity or optical data associated with a sensor in another room for example. In the case of an unexpected presence, activity in another room may indicate in fact that an intruder has entered the premises. In the case of an inactivity sensor, secondary sensor output could confirm a lack of activity in other parts of a home or conversely indicate activity in another part of a home. When the status has not been resolved ("NO" path out of decision block 725), the device may display a request message at block 735 to inquire is assistance is needed. When an alert is required ("YES" path out of decision block 725), the device can transmit an alert at block 730. Alerts transmitted at block 730 may be to one or more of to a server, communication device, contact, security service and dispatch service.

While this disclosure has been particularly shown and described with references to exemplary embodiments thereof, it will be understood by those skilled in the art that various changes in form and details may be made therein without departing from the scope of the embodiments encompassed by the appended claims.

What is claimed is:

1. A method for monitoring and reporting activity including providing an alert based on detected activity, the method comprising the acts of:

monitoring activity relative to a device based on activity detected by the device;

determining a baseline activity level for the device associated with a time period based on activity level data collected over a plurality of time periods;

detecting an atypical activity level in a given time period as compared to the baseline activity level for the given time period;

transmitting an electronic message via a network connection in response to detecting the atypical activity level, the electronic message providing an alert.

2. The method of claim 1, wherein monitoring activity is based on one or more of optical and infrared detection of at least one of motion and a presence relative to the device.

3. The method of claim 1, wherein monitoring activity relates to detecting and characterizing activity relative to one or more detection zones of the device.

4. The method of claim 1, wherein monitoring activity includes periodic capturing of image data by the device and determining activity based on changes in detected image data.

5. The method of claim 1, wherein baseline activity characterizes user activity relative to the device and is determined for intervals and sub-intervals on a daily basis.

6. The method of claim 1, wherein the electronic message relates to an email message transmitted to a dispatch service requesting assistance based on a determination of inactivity.

7. The method of claim 1, wherein the electronic message includes image data captured by the device.

8. The method of claim 1, further comprising receiving activity data from a sensor separate from the device, wherein the change in baseline activity is based on data associated with the sensor.

9. The method of claim 1, further comprising displaying a message by the device in response to detecting the atypical activity level, the message requesting a user response regarding inactivity.

10. A device comprising:

a sensor configured to detect activity relative to the device;

a communication module, and a processor coupled to the sensor and the communication module, the processor configured to:

monitor activity relative to the device based on activity detected by the sensor;

determine a baseline activity level for the device associated with a time period based on activity level data collected over a plurality of time periods;

detect an atypical activity level in a given time period as compared to the baseline activity level for the given time period;

control transmission of an electronic message via a network connection in response to detecting the atypical activity level, the electronic message providing an alert.

11. The device of claim 10, wherein the device relates to one or more of a display device, set-top box, communication device, media player, gaming device or electronic device in general.

12. The device of claim 10, wherein monitoring activity is based on one or more of optical and infrared detection of at least one of motion and a presence relative to the device.

13. The device of claim 10, wherein monitoring activity relates to detecting and characterizing activity relative to one or more detection zones of the sensor.

14. The device of claim 10, wherein monitoring activity includes periodic capturing of image data by the sensor and determining activity based on changes in detected image data.

15. The device of claim 10, wherein baseline activity characterizes user activity relative to the device and is determined for intervals and sub-intervals on a daily basis.

16. The device of claim 10, wherein the electronic message relates to an email message transmitted to a dispatch service to request assistance based on a determination of inactivity.

17. The device of claim 10, wherein the electronic message includes image data captured by the sensor.

18. The device of claim 10, the processor further configured to receive activity data from a sensor separate from the device, wherein the baseline activity level is based on data associated with the sensor.

19. The device of claim 10, the processor further configured to control display of a message by the device in response to detecting the atypical activity level, the message requesting a user response regarding inactivity.

20. A computer program product stored on a non-transitory computer readable medium including computer executable code for monitoring and reporting activity including providing an alert based on detected activity, the computer program product comprising:

computer readable code to monitor activity relative to a device based on activity detected by a sensor;

computer readable code to determine a baseline activity level for the device associated with a time period based on activity level data collected over a plurality of time periods;

computer readable code to detect an atypical activity level in a given time period as compared to the baseline activity level for the given time period; and computer readable code to control transmission of an electronic message via a network connection in response to detecting the atypical activity level, the electronic message providing an alert based on the change in baseline activity level.

* * * * *